US009550286B2

(12) United States Patent
Bonds et al.

(10) Patent No.: US 9,550,286 B2
(45) Date of Patent: Jan. 24, 2017

(54) APPARATUS FOR REMOVING PIN FROM TARGET LOCATION

(71) Applicant: Caterpillar Inc., Peoria, IL (US)

(72) Inventors: Bradley T. Bonds, Tishomingo, MS (US); Michael J. Gunn, Walnut, MS (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/940,176

(22) Filed: Nov. 13, 2015

(65) Prior Publication Data

US 2016/0067852 A1 Mar. 10, 2016

(51) Int. Cl.
*B25B 27/04* (2006.01)

(52) U.S. Cl.
CPC ..... *B25B 27/04* (2013.01)

(58) Field of Classification Search
CPC ..... B25B 27/04
USPC ..... 29/254
See application file for complete search history.

(56) References Cited

U.S. PATENT DOCUMENTS

| | | | | | |
|---|---|---|---|---|---|
| 3,529,497 | A * | 9/1970 | Brooks | B25B 27/02 173/91 |
| 4,034,594 | A * | 7/1977 | Morgan | B21D 1/06 29/255 |
| 2016/0052114 | A1 * | 2/2016 | Claver | B25B 27/12 29/426.1 |

FOREIGN PATENT DOCUMENTS

| | | | | |
|---|---|---|---|---|
| FR | 2963269 | | 2/2012 | |
| FR | 2963269 | A1 * | 2/2012 | B25B 27/02 |
| GB | 2241661 | | 9/1991 | |
| GB | 2241661 | A * | 9/1991 | B25C 11/02 |
| JP | 11033929 | | 2/1999 | |
| JP | 11033929 | A * | 2/1999 | |

* cited by examiner

*Primary Examiner* — Joseph J Hail
*Assistant Examiner* — Marc Carlson

(57) ABSTRACT

An apparatus for removing a pin from a target location is described. The apparatus includes a rod; a clamp that includes multiple arms and attached to a one end of the rod; a sleeve coupled to the rod and adapted to enclose the clamp, where the arms of the clamp are pushed towards each other to engage with a pin in the enclosed position. The apparatus further includes a clip member to couple with the rod for removing the pin from the clamp by disengaging the clamp from the sleeve. The clip member includes a first arm coupled to a second arm via a pivot member, the clip member being adapted to couple to the rod between the sleeve and a hammer. The hammer is coupled to the rod and adapted to strike a force on the clip member to disengage the clamp from the sleeve.

1 Claim, 6 Drawing Sheets

APPARATUS FOR REMOVING PIN FROM TARGET LOCATION

TECHNICAL FIELD

The present disclosure relates to an apparatus for removing a pin from a target location and more specifically for removing a press fitted dowel pin from the target location.

BACKGROUND

Dowel pins are employed at various target locations, such as engine heads and blocks, to precisely position component parts of a structure during assembly operation. However, over a period of time, the dowel pins are worn, bent, or otherwise damaged, thereby requiring removal and replacement during the assembly operation. In order to remove the dowel pin from the target location, an appropriately formed dowel-pin removing tool is attached to the dowel pin to remove it from the target location. However, for further use of the dowel removing tool, the dowel pin needs to be disengaged from the dowel removing tool. Accordingly, for the purpose of removing the dowel pin from the dowel removing tool, a traditional hammer is employed to strike a force on a rod of the dowel removing tool.

U.S. Pat. No. 3,529,497 ('497 patent) describes a dowel removing tool. The dowel removing tool of the '497 patent includes a dowel gripping member which is radially contractible to grip the dowel pin and radially expands to release the dowel pin. The dowel removing tool of the '497 patent also includes a reaction means provided on the dowel removing tool in a oppositely spaced relation with respect to the dowel gripping member and an impact means slidably mounted on the dowel removing tool between the dowel gripping member and the reaction means for manually actuating reciprocal movement against the dowel gripping member to contract the same tightly about a dowel and subsequently to remove the dowel by engagement of the impact means against the reaction means. Although the '497 patent fails to disclose methods for removing the extracted dowel from the dowel removing tool, it will be understood by a person skilled in the art that the traditional hammer still needs to be employed by the operator to strike a force on the dowel removing tool for removing the extracted dowel from the dowel removing tool.

SUMMARY OF THE DISCLOSURE

According to an aspect of the present disclosure, an apparatus for removing a pin from a target location is provided. The apparatus includes a rod having a first end and a second end, and a clamp attached to the first end of the rod. The clamp includes a number of arms adapted to receive the pin therebetween. The apparatus also includes a sleeve coupled to the rod and adapted to move between a first position and a second position. The sleeve is engaged with the clamp in the first position and disengaged from the clamp in the second position. The arms of the clamp are pushed towards each other in the first position of the sleeve to engage with the pin. The apparatus further includes a hammer coupled to the rod and adapted to move the sleeve to the first position. The apparatus further includes a handle attached to the second end of the rod. The apparatus further includes a clip member adapted to couple to the rod for removing the pin from the clamp. The clip member includes a first arm and a second arm. Each of the first arm and the second arm has a first end and a second end. The second arm of the clip member is coupled to the first arm via a pivot member. The clip member is configured to move from a non-deflected position to a deflected position. In the deflected position of the clip member, the first end of the first arm is away from the first end of the second arm. The clip member further includes a first coupling member attached to the first end of the first arm and a second coupling member attached to the first end of the second arm. The first coupling member and the second coupling member define an opening in the non-deflected position of the clip member. The opening has an inner diameter greater than or equal to an outer diameter of the rod. Further, the first coupling member and the second coupling member together define an outer diameter less than an inner diameter of the sleeve. The clip member is coupled to the rod between the sleeve and the hammer. Furthermore, the hammer moves at least one of the first coupling member and the second coupling member towards the clamp to disengage the clamp from the sleeve and release the pin from the clamp.

Other features and aspects of this disclosure will be apparent from the following description and the accompanying drawings.

DETAILED DESCRIPTION

Reference will now be made in detail to specific embodiment or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claim.

Figure 1:
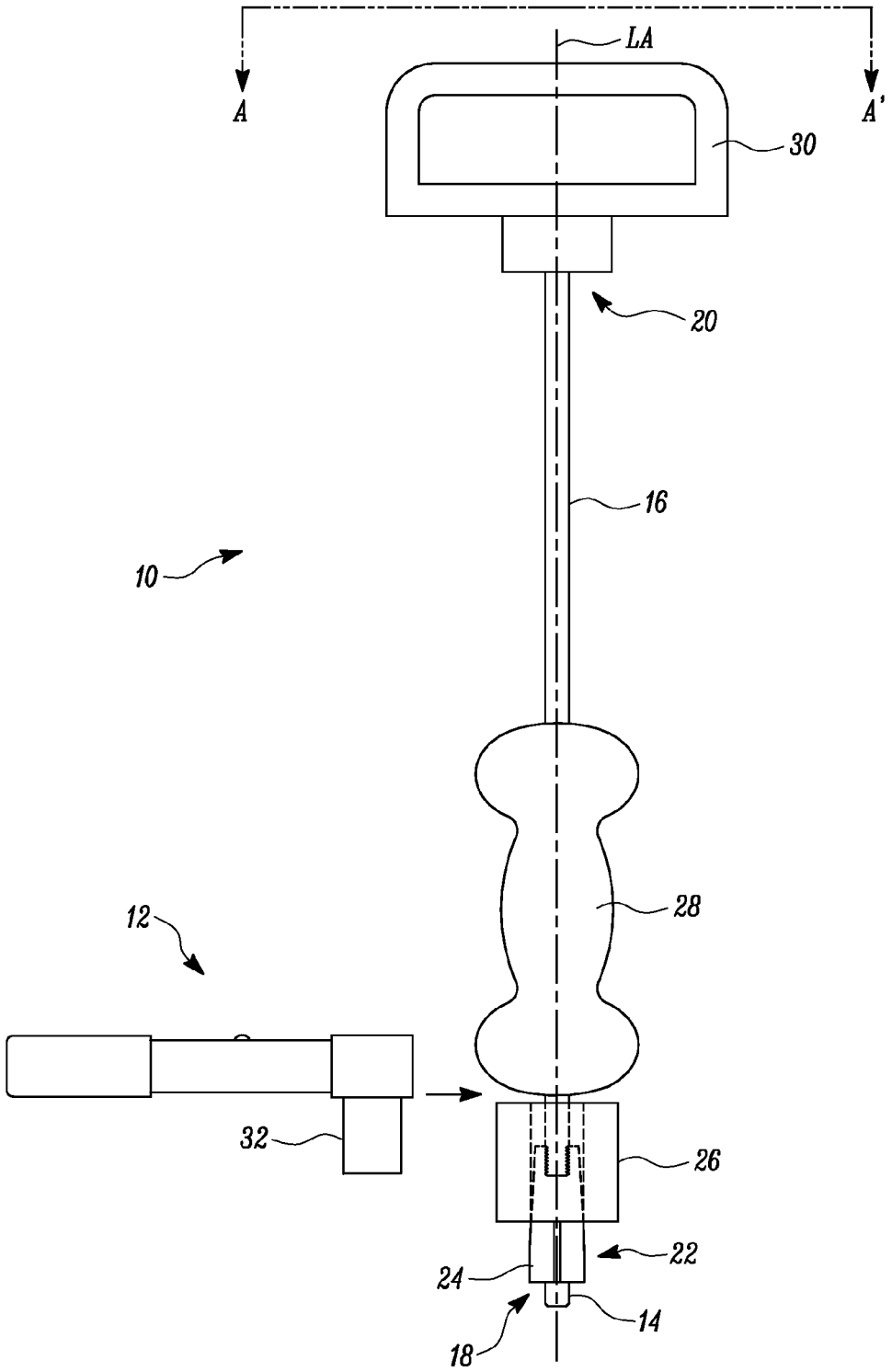
FIG. 1 is a front view of an apparatus and a clip member associated with the apparatus for removing a pin from a target location, in accordance with the concepts of the present disclosure.

Referring to FIG. 1 the apparatus 10 includes a rod 16 having a first end 18 and a second end 20. A handle 30 is attached to the second end 20 of the rod 16. The handle 30 is provided for the operator to hold the apparatus 10 and also move the apparatus 10 from one position to the other. The apparatus 10 further includes a clamp 22 attached to the first end 18 of the rod 16. The clamp 22 includes arms 24 to hold a pin 14 therebetween when the apparatus 10 is used to remove the pin 14 from a target location 62. In an example, the clamp 22 may include four arms. The apparatus 10 also includes a sleeve 26. The sleeve 26 is embodied as a hollow cylindrical structure. As such, the sleeve 26 is coupled to the rod 16 in such a way that the sleeve 26 moves along a longitudinal axis "LA" of the rod 16. Further, the apparatus 10 includes a hammer 28. The hammer 28 is also coupled to the rod 16 in a manner that the hammer 28 moves along the longitudinal axis "LA" of the rod 16. The hammer 28 is provided as a dumble-shaped structure, so that the hammer 28 is easily graspable by an operator. With such construction of the apparatus 10, the sleeve 26 is disposed between the clamp 22 and the hammer 28. The hammer 28 is used to strike the sleeve 26 at a first desired force to engage the pin 14 with the clamp 22 during removal of the pin 14 from the target location 62. The hammer 28 is moved along the rod 16 between the handle 30 and the sleeve 26 to apply the first desired force on the sleeve 26. As shown in FIG. 1 a clip member 12 is adapted to couple to the rod 16 of the apparatus 10. The clip member 12 includes a coupling member 32 for releasing the pin 14 from the clamp 22

Figure 2:
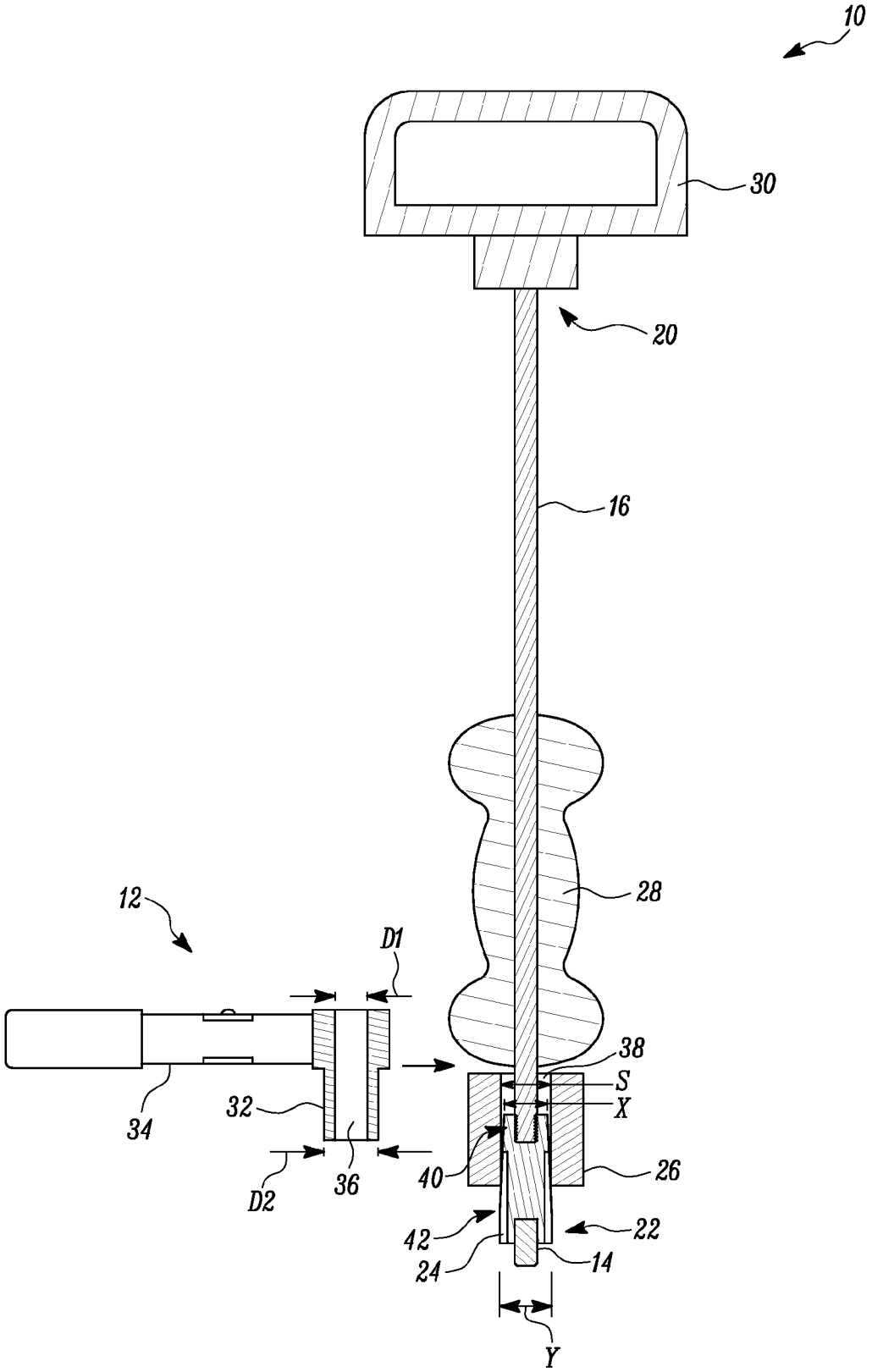
FIG. 2 is a sectional view of the apparatus taken along line A-A' in FIG. 1, in accordance with the concepts of the present disclosure.

Referring to FIG. 2, the coupling member 32 of the clip member 12 extends in a direction perpendicular to a pair of arms 34 of the clip member 12. One of the pair of arms 34 is shown in FIG. 2. The coupling member 32 includes an opening 36 having an inner diameter "D1". The opening 36 defines an inner surface that surrounds an outer surface of the rod 16 when the clip member 12 is coupled to the rod 16. The coupling member 32 also defines an outer diameter "D2".

The sleeve 26 includes a through hole 38 such that the sleeve 26 is disposed coaxially on the rod 16 to slide along the longitudinal axis "LA" of the rod 16. The through hole 38 has an inner diameter "S" that is greater than the outer diameter D2 of the coupling member 32. Accordingly, the coupling member 32 is inserted within the through hole 38 during the removal of the pin 14 from the clamp 22. Further, the clamp 22 includes a first end 40 having an outer diameter "X" and a second end 42 having an outer diameter "Y", the outer diameter "Y" being greater than the outer diameter "X". In addition, the outer diameter of the clamp 22 increases linearly from the first end 40 to the second end 42 to define a taper portion between the first end 40 and the second end 42 of the clamp 22. Furthermore, the outer diameter "X" of the first end 40 of the clamp 22 is less than the inner diameter "S" of the sleeve 26.

The sleeve 26 is adapted to move between a first position "P1" and a second position "P2". The sleeve 26 is moved around the clamp 22 to engage with the clamp 22 in the first position "P1" and is moved away from the clamp 22 to disengage from the clamp 22 in the second position "P2". In the first positon "P1" of the sleeve 26, the arms 24 of the clamp 22 are pushed radially in an inward direction towards each other to engage with the pin 14.

Figure 3:
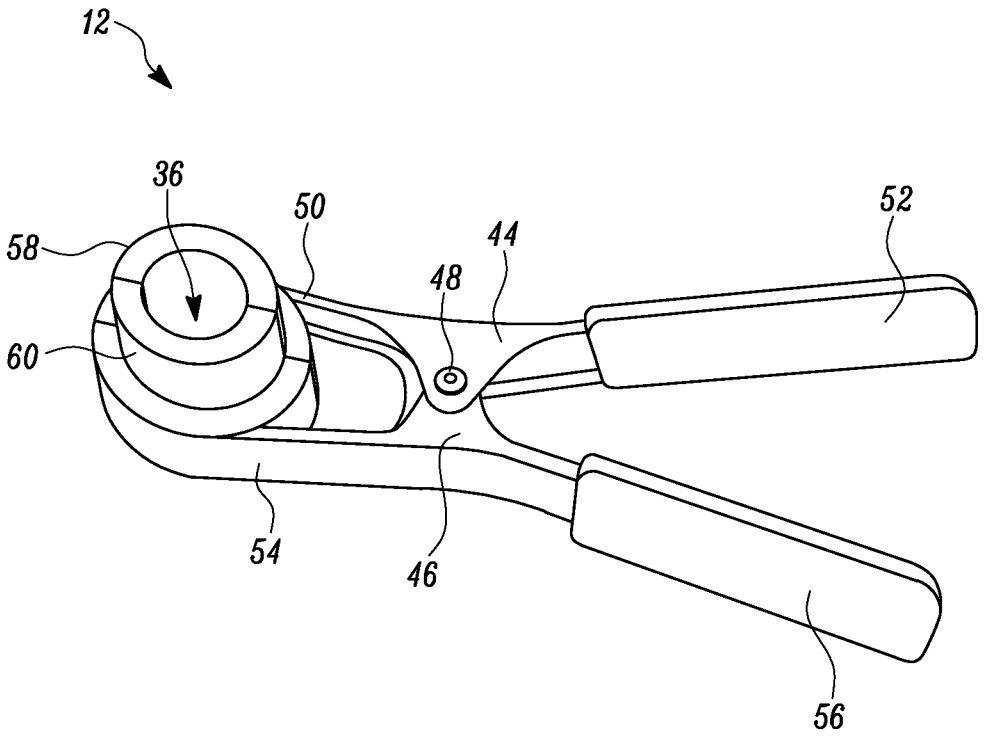
FIG. 3 is a perspective view of the clip member, in accordance with the concepts of the present disclosure.

FIG. 3 shows the clip member 12 for the apparatus 10. As mentioned earlier, the clip member 12 includes the pair of arms 34. The pair of arms 34 includes a first arm 44 and a second arm 46. The second arm 46 is coupled to the first arm 44 through a pivot member 48. The first arm 44 has a first end 50 and a second end 52. The second arm 46 has a first end 54 and a second end 56. The clip member 12 is movable between a non-deflected position and a deflected position. A spring member (not shown) is disposed between the first arm 44 and the second arm 46. The spring member biases the clip member 12 to the non-deflected position in normal condition of the clip member 12. In the deflected position, the first arm 44 and the second arm 46 move about the pivot member 48 against a biasing force of the spring member. The first end 50 of the first arm 44 is away from the first end 54 of the second arm 46 in the deflected position. However, the first end 50 of the first arm 44 rests against the first end 54 of the second arm 46 in the non-deflected position of the clip member 12, as shown in FIG. 3.

The coupling member 32 of the clip member 12 includes a first coupling member 58 and a second coupling member 60. The first coupling member 58 is attached to the first end 50 of the first arm 44 and the second coupling member 60 is attached to the first end 54 of the second arm 46. In the non-deflected position, the first coupling member 58 rests against the second coupling member 60 and, in the deflected position, the first coupling member 58 is away from the second coupling member 60. Furthermore, in the non-deflected position, the first coupling member 58 and the second coupling member 60 define the opening 36 therebetween.

Although the clip member 12 includes the pair of arms 34, it will be understood by one skilled in the art that the clip member 12 can include only one arm with a coupling member. In one example, the second end 52 of the first arm 44 and the second end 56 of the second arm 46 can have a rounded-end, similar to ends of a pair of scissors. Various embodiments disclosed herein are to be taken in the illustrative and explanatory sense, and should in no way be construed as limiting of the present disclosure.

INDUSTRIAL APPLICABILITY

Figure 4:
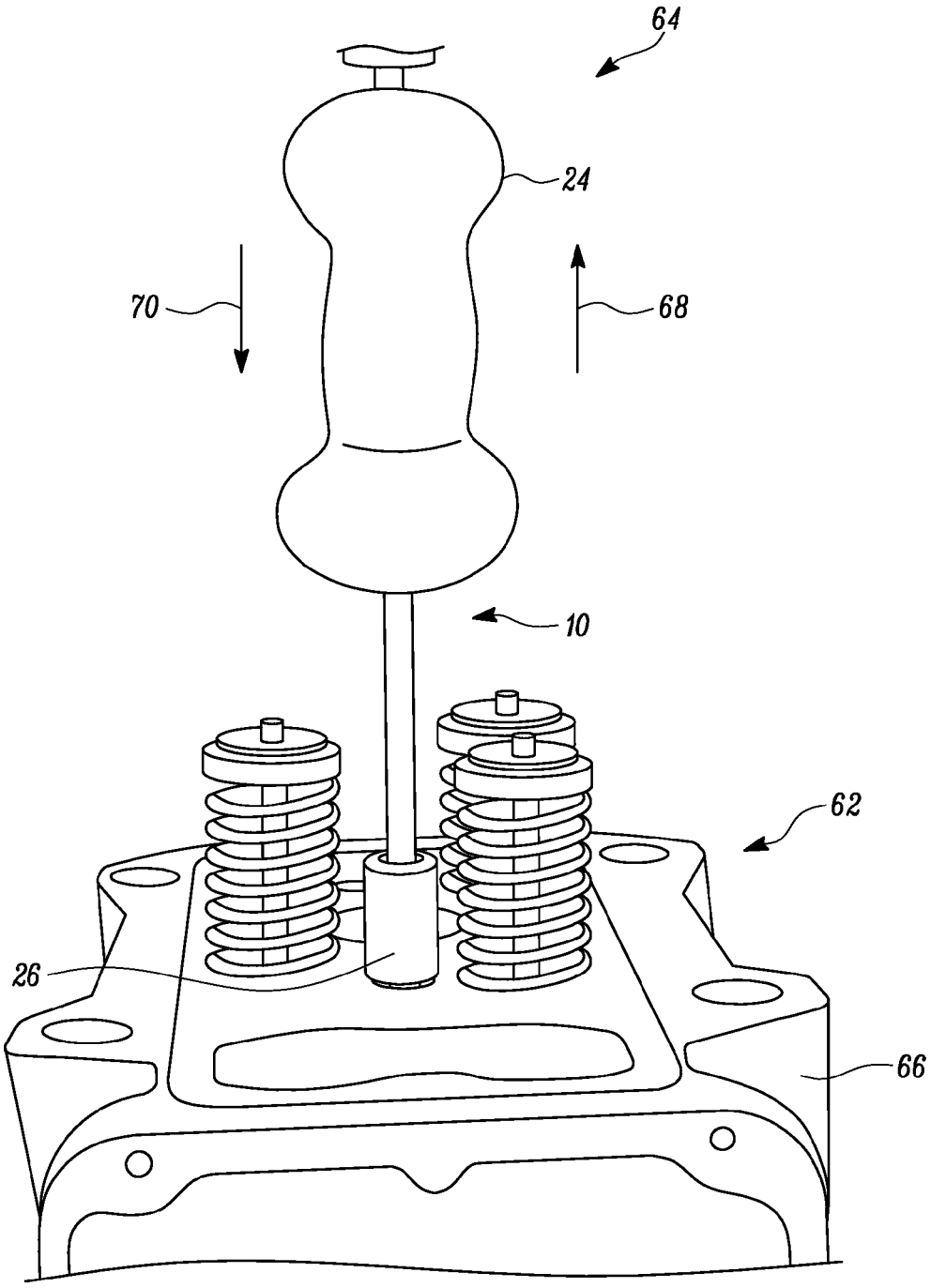
FIG. 4 is perspective view of the apparatus in operation disclosing a method of extracting the pin from the target location in accordance with the concepts of the present disclosure.

The present disclosure relates to the apparatus 10 for removing the pin 14 from the target location 62. FIG. 4 shows a method 64 of extracting the pin 14 from the target location 62. In one example, the target location 62 may be one of, but not limiting to, an engine crankcase 66. In another example, the target location 62 may be any component having the pin 14 coupled thereto. In one example, the pin 14 may be a dowel pin or a locating pin.

The method 64 includes engaging the pin 14 with the clamp 22 of apparatus 10. The handle 30 of the apparatus 10 is held by one hand of the operator and the hammer 28 is moved towards the handle 30 in an upward direction 68. The hammer 28 is further moved towards the sleeve 26 in a downward direction 70 to strike the sleeve 26 with the first desired force. Due to the first desired force, the sleeve 26 is pushed towards the clamp 22 in the first position "P1", thereby pushing the arms 24 of the clamp 22 in the radial inward direction towards each other. As such, the arms 24 of the clamp 22 engage with the pin 14. Once the operator has struck a particular number of strokes on the sleeve 26, the hammer 28 is moved in the upward direction 68 to disengage the pin 14 from the engine crankcase 66.

Figure 5:
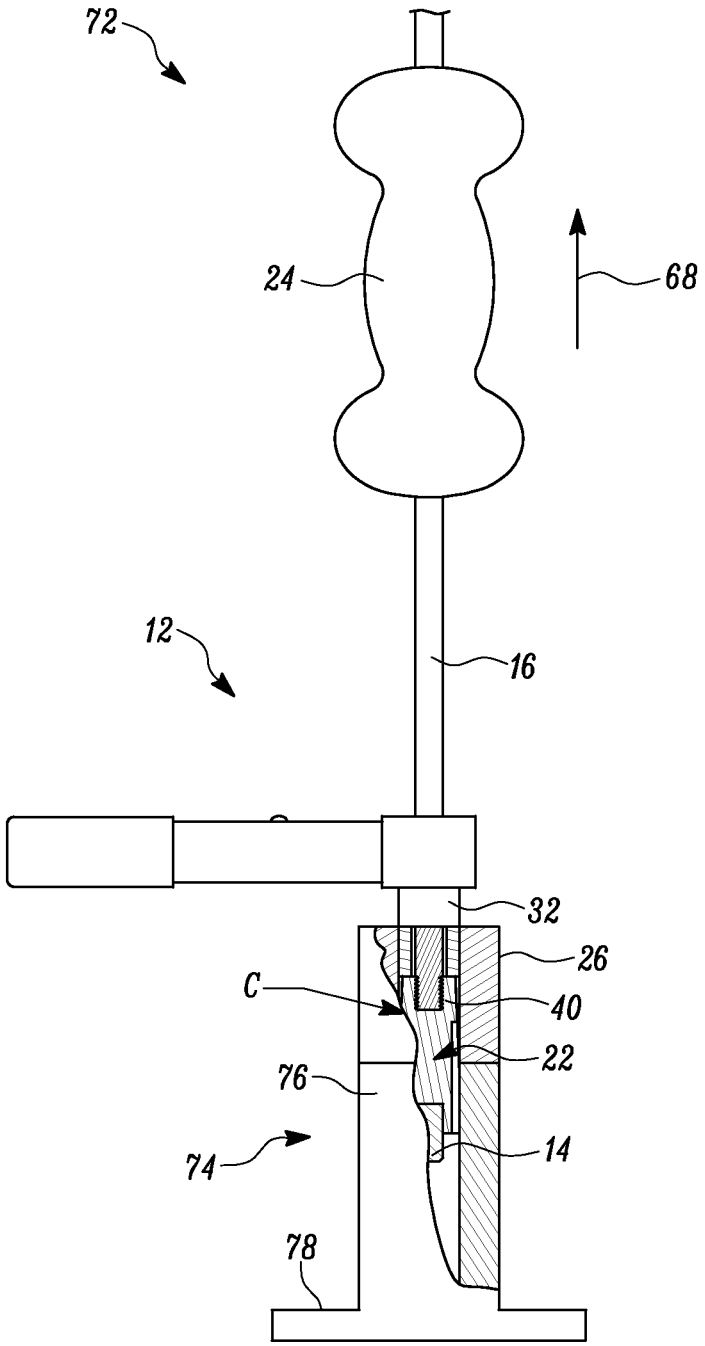
FIG. 5 is a partial sectional view of the apparatus in operation disclosing a method of removing the pin from the apparatus.
Figure 6:
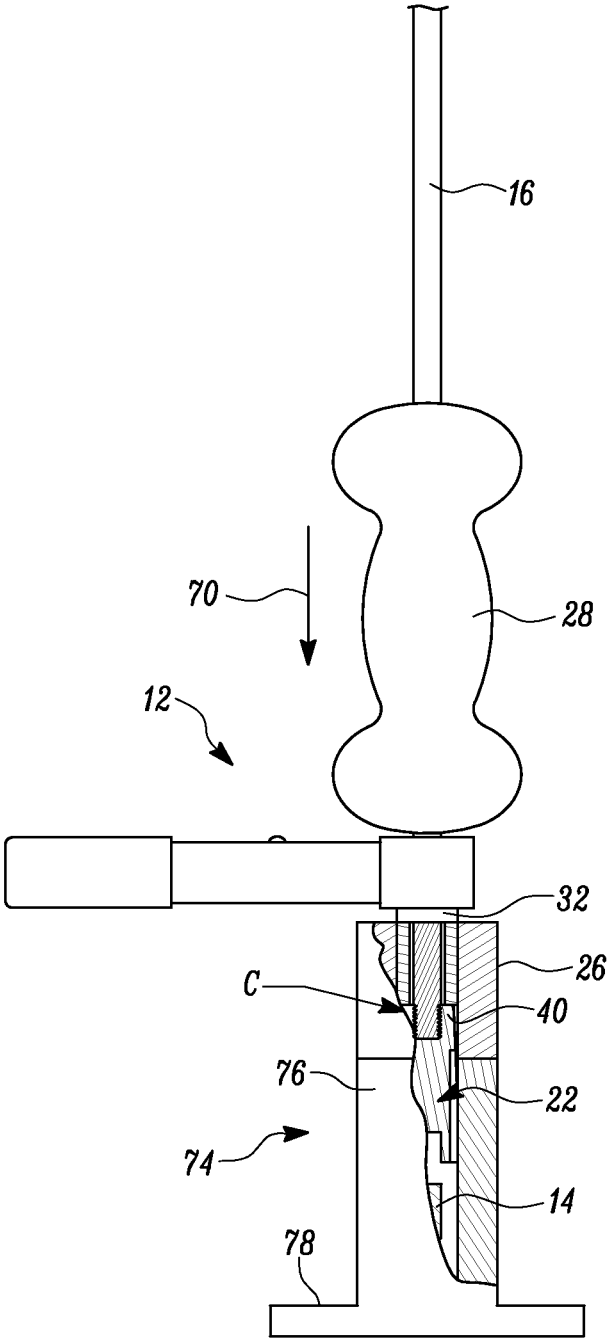
FIG. 6 is a partial sectional view of the apparatus with the pin shown in removed condition from the apparatus.

FIG. 5 and FIG. 6 show a method 72 for releasing the pin 14 from the apparatus 10. In addition, FIG. 5 and FIG. 6 also show a cut-section "C" for the convenience of the description. Once the apparatus 10, with the pin 14 attached to the apparatus 10, is disengaged from the target location 62, such as the engine crankcase 66, the apparatus 10 is engaged with a support fixture 74. The support fixture 74 includes a hollow cylindrical body 76 and a base member 78. The apparatus 10 is vertically positioned on the support fixture 74. The apparatus 10 is disposed vertically on the support fixture 74, such that the sleeve 26 rests against the hollow cylindrical body 76 of the support fixture 74.

Further, the clip member 12 is coupled to the apparatus 10 in such a way that the clip member 12 is located between the hammer 28 and the sleeve 26. Further, the clip member 12 is moved in the downward direction 70, so that the coupling member 32 is received in the sleeve 26. During the pin removal process, since the inner diameter "S" of the sleeve 26 is greater than the outer diameter "D2" of the coupling member 32 of the clip member 12, the coupling member 32 rests against the first end 40 of the clamp 22 when the coupling member 32 is inserted in the sleeve 26. Further, the outer diameter "X" of the first end 40 of the clamp 22 is greater than the inner diameter "D1" of the coupling member 32. With such an arrangement, the coupling member 32 rests against the first end 40 of the clamp 22. Further, the hammer 28 is reciprocated in the downward direction 70 and the upward direction 68 with a second desired force striking each time on the clip member 12.

Due to the second desired force struck each time, the clip member 12 is pushed in the downward direction 70. Since the coupling member 32 rests against the first end 40 of the clamp 22, the second desired force applied on the clip member 12 is transmitted to the clamp 22. As such, the clamp 22 is pushed further in the downward direction 70. With such pushing of the clamp 22 in the downward direction 70, the clamp 22 is disengaged from the sleeve 26. The disengagement of the clamp 22 from the sleeve 26 allows the arms 24 of the clamp 22 to radially expand, thereby releasing the pin 14 in the hollow cylindrical body 76 of the support fixture 74, as shown in FIG. 6.

Therefore, the clip member 12 of the apparatus 10 assists the operator to support the apparatus 10 in one hand while striking the desired forces by the other hand. Additionally, owing to the presence of the clip member 12 and the second desired force being struck on the clip member 12, the pin 14 can be disengaged from the clamp 22 without any extra effort from the operator. In other words, the clip member 12 cooperates with the hammer 28 to disengage from the pin 14 from the clamp 22, thereby eliminating need of striking a force by a traditional hammer. Accordingly, any ergonomic risk to the operator's hand is eliminated.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An apparatus for removing a pin from a target location, the apparatus comprising:

a rod having a first end and a second end;

a clamp attached to the first end of the rod, the clamp comprising a plurality of arms adapted to receive the pin therebetween;

a sleeve coupled to the rod, the sleeve adapted to move between a first position and a second position, wherein the sleeve is engaged with the clamp in the first position and disengaged from the clamp in the second position, and wherein the plurality of arms of the clamp is pushed towards each other to engage with the pin in the first position;

a hammer coupled to the rod, the hammer adapted to move the sleeve to the first position;

a handle attached to the second end of the rod; and a clip member adapted to couple to the rod for removing the pin from the clamp, the clip member comprising:

a first arm comprising a first end and a second end;

a second arm coupled to the first arm via a pivot member, the second arm comprising a first end and a second end, the clip member is structured and arranged to move from a non-deflected position to a deflected position, wherein the first end of the first arm is away from the first end of the second arm in the deflected position;

a first coupling member attached to the first end of the first arm; and a second coupling member attached to the first end of the second arm, the first coupling member and the second coupling member define an opening in the non-deflected position of the clip member, the opening has an inner diameter greater than or equal to an outer diameter of the rod, wherein the first coupling member and the second coupling member together define an outer diameter less than an inner diameter of the sleeve, and the clip member is coupled to the rod between the sleeve and the hammer, and wherein the hammer moves at least one of the first coupling member and the second coupling member towards the clamp to disengage the clamp from the sleeve and release the pin from the clamp.

* * * * *